US006336384B1

(12) United States Patent
Huang

(10) Patent No.: US 6,336,384 B1
(45) Date of Patent: Jan. 8, 2002

(54) ADJUSTABLE WRENCH

(76) Inventor: Ping Wen Huang, 1F, No. 364, Sec. 2, Chung-Yang Rd., Hsien-Hsi Tsun, Chang Hua Hsien (TW)

( * ) Notice: Subject to any disclaimer, the term of this patent is extended or adjusted under 35 U.S.C. 154(b) by 0 days.

(21) Appl. No.: 09/667,627

(22) Filed: Sep. 22, 2000

(51) Int. Cl.[7] ..... B25B 13/16
(52) U.S. Cl. ..... 81/165; 81/126; 81/157
(58) Field of Search ..... 81/126, 157, 165

(56) References Cited

U.S. PATENT DOCUMENTS 2,562,060 A * 7/1951 Pehrsson ..... 81/126
3,349,654 A * 10/1967 Nordgren ..... 81/126
3,407,689 A * 10/1968 Slayton ..... 81/126 X

* cited by examiner

*Primary Examiner*—James G. Smith
(74) *Attorney, Agent, or Firm*—Rosenberg, Klein & Lee

(57) ABSTRACT

An Adjustable wrench including a main body, a slide block, a movable jaw and a grip. The main body has a jaw section and a hollow section in which the slide block and the movable jaw are disposed. The grip is pivotally connected with the hollow section. The slide block has a projecting section slidably inserted in the slide channels of the main body. A top face of the projecting section is formed with a semicircular groove. A lower portion of the movable jaw is a projecting rail complementary to the slide channels of the main body. A bottom face of the projecting rail is formed with a concave face cooperating with the semicircular groove of the slide block. The concave face is formed with a thread. The projecting rail of the movable jaw and the projecting section of the slide block are together inlaid in the slide channels of the main body. A bolt is passed through the concave face of the movable jaw and the semicircular groove of the slide block with the bolt screwed with the thread of the concave face for driving the movable jaw to move along the slide channels. A movable retaining block is disposed on one side of the top end of the grip opposite to a leaning section of the slide block. The retaining block can be switched, whereby when the grip is wrenched in different directions, the retaining block pushes the leaning section of the slide block so as to change the one-way wrenching direction of the adjustable wrench during repeated wrenching operation for a work piece.

4 Claims, 13 Drawing Sheets

ADJUSTABLE WRENCH

BACKGROUND OF THE INVENTION

The present invention relates to an adjustable wrench which is able to change the one-way-wrenching direction of the adjustable wrench during repeated wrenching operation for a work piece.

FIGS. 11 and 12 show a conventional adjustable wrench 8 having a main body 81. A jaw section 82 extends from one side of the main body 81, while a grip 83 is pivotally disposed at the other end of the main body 81. A slidably movable jaw 84 is disposed in a slide way 811 of the main body 81. The movable jaw 84 has a push block 841 protruding out of the main body 81. One side of the front end of the grip 83 inside the main body 81 has a driving section 831 for pushing and driving a slide block 85 to disengage a toothed section 851 thereof from or engage the toothed section 851 with a toothed section 842 of the movable jaw 84. When the grip 83 is wrenched clockwise in a direction of the figure, the slide block 85 is driven to engage with the movable jaw 84 and the jaw section 82 of the main body 81 and the movable jaw 84 cooperatively clamp a work piece 9 (such as a bolt and a nut) and rotate the same. When the grip 83 is counterclockwise wrenched, the slide block 85 is moved away from the movable jaw 84. Therefore, when the main body 81 is driven by the grip 83, the movable jaw 84 will be forced away by the work piece 9 to idle, whereby when repeatedly wrenching the adjustable wrench 8, the work piece 9 can be only one-way rotated.

The work piece 9 can be one-way rotated by means of repeatedly wrenching the above adjustable wrench 8. However, when it is necessary to reversely rotate the work piece 9, (for example, in order to control the nut and bolt to have unified pre-load, the nut is often first tightened and then untightened by one third cycle) a user needs to take up and separate the adjustable wrench 8 from the work piece 9 and re-adjust the position of the movable jaw 84 and then reversely fit the adjustable wrench 8 onto the work piece 9 so as to reversely wrench the work piece 9. Such procedure is quite troublesome. In the case that the work piece 9 is a bolt for adjustment, the user will have to continuously repeat the above procedure to adjust the work piece 9.

SUMMARY OF THE INVENTION

It is therefore a primary object of the present invention to provide an adjustable wrench in which the projecting rail of the movable jaw and the projecting section of the slide block are together inlaid in the slide channels of the main body. A bolt is passed through the concave face of the movable jaw and the semicircular groove of the slide block with the bolt screwed with the thread of the concave face for driving the movable jaw to move along the slide channels. A movable retaining block is disposed on one side of the top end of the grip opposite to a leaning section of the slide block. The retaining block can be switched, whereby when the grip is wrenched in different directions, the retaining block abuts against and pushes the leaning section of the slide block so as to move the movable jaw toward the jaw section of the main body for clamping and wrenching a work piece. When the retaining section does not abut against and the leaning section and the grip is wrenched, the slide block and the movable jaw are shifted by the work piece to make the main body idle. By means of switching the retaining block, the one-way wrenching direction of the adjustable wrench during repeated wrenching operation for the work piece can be changed.

The present invention can be best understood through the following description and accompanying drawings wherein:

DETAILED DESCRIPTION OF THE PREFERRED EMBODIMENTS

Figure 1:
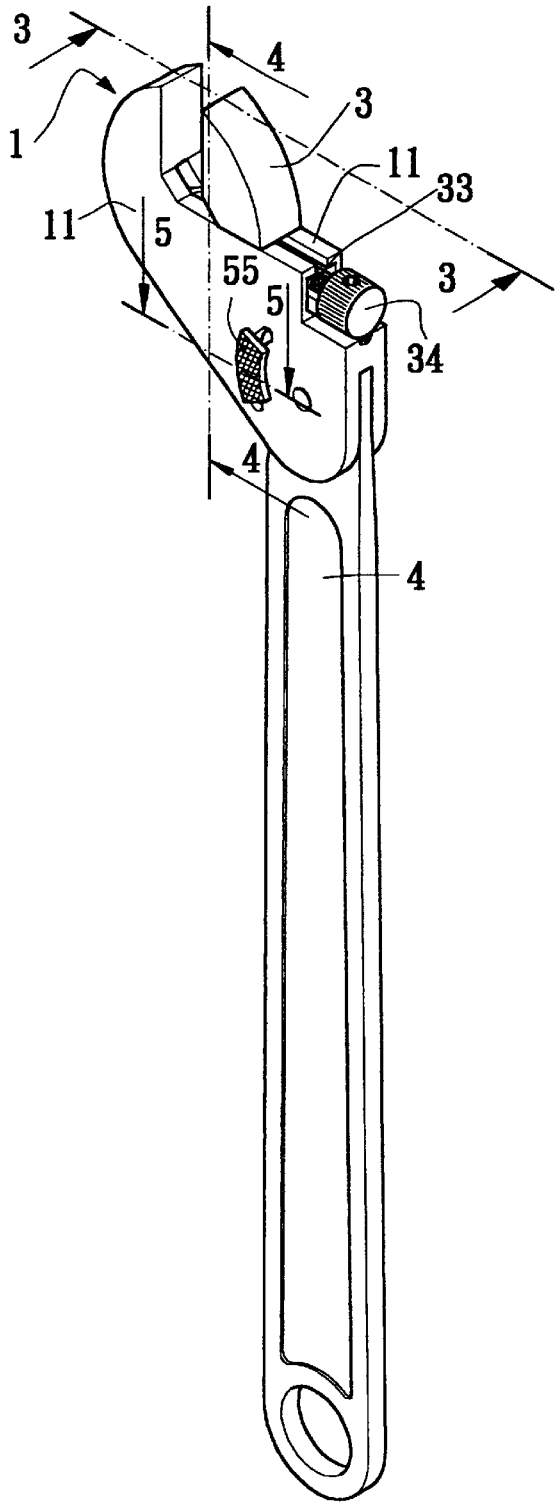
FIG. 1 is a perspective assembled view of the present invention.
Figure 2:
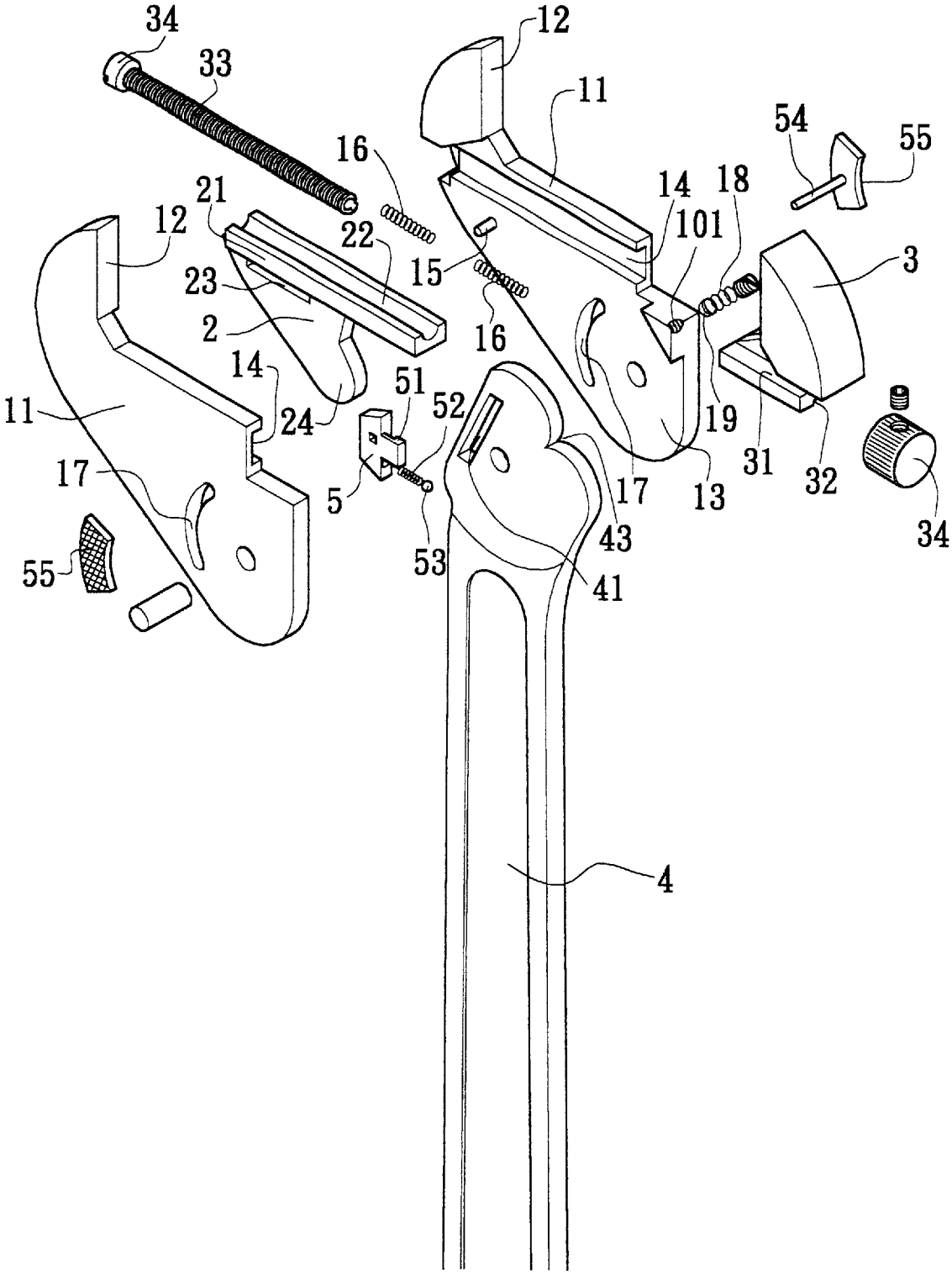
FIG. 2 is a perspective exploded view of the present invention.
Figure 3:
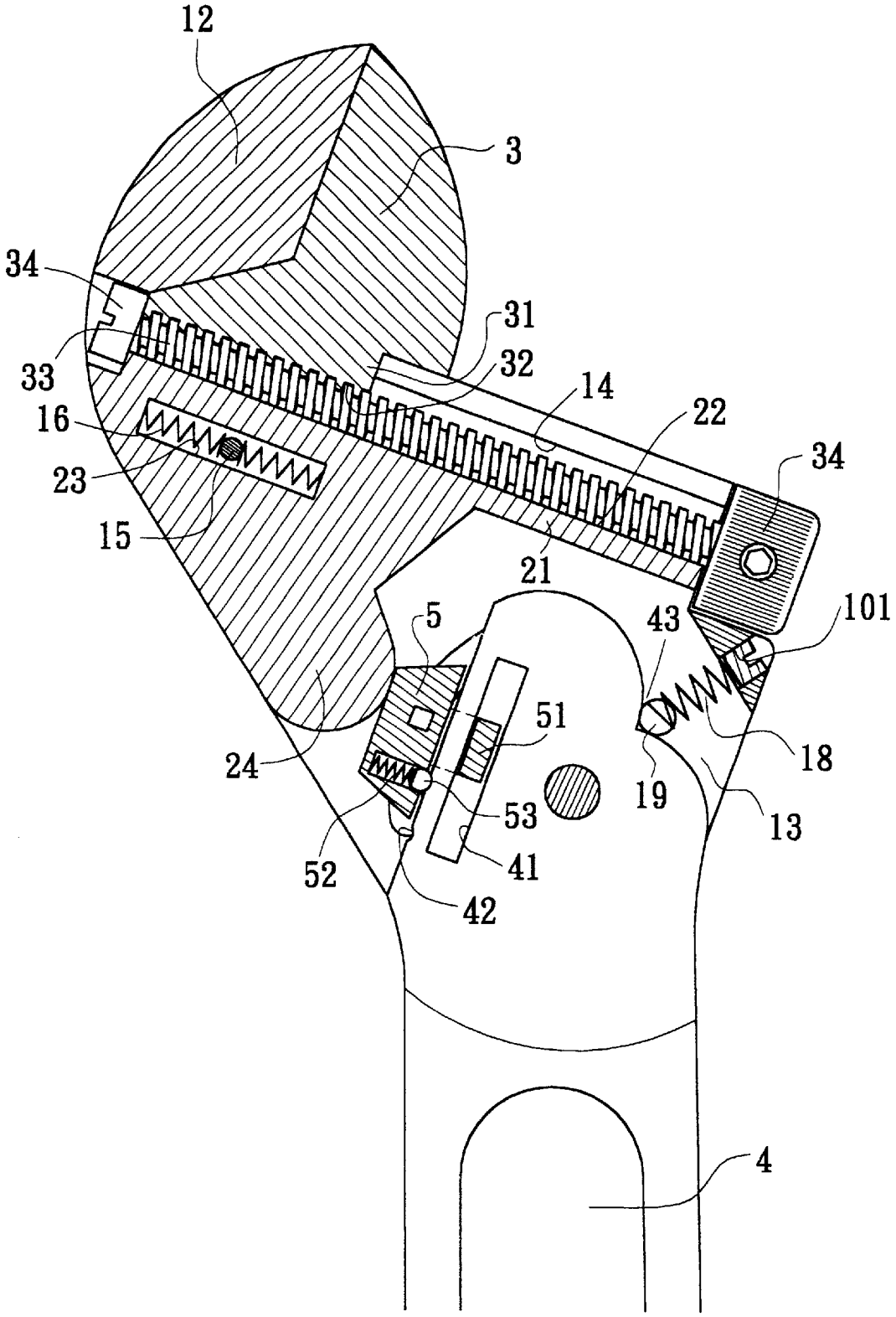
FIG. 3 is a sectional view taken along line 3–3 of FIG. 1.
Figure 5:
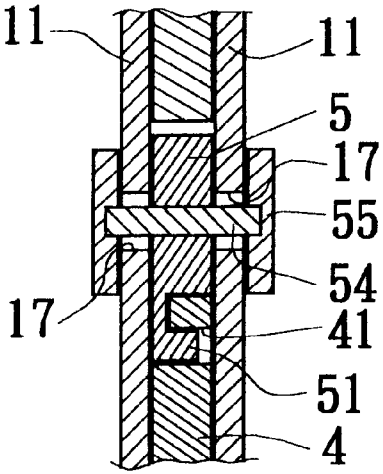
FIG. 5 is a sectional view taken along line 5—5 of FIG. 1.
Figure 4:
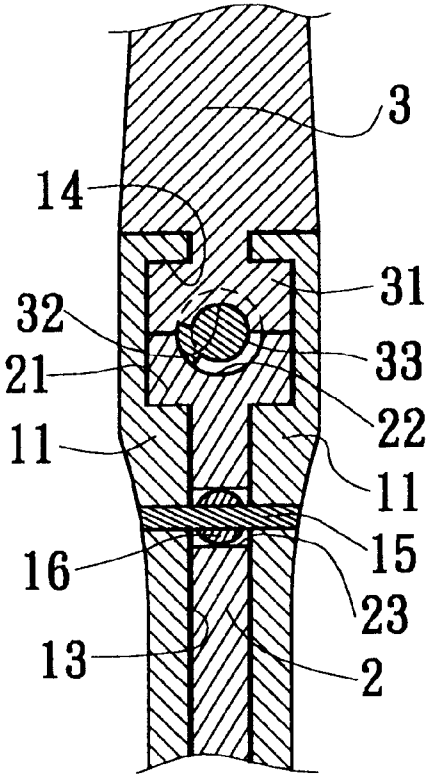
FIG. 4 is a sectional view taken along line 4—4 of FIG. 1.

Please refer to FIGS. 1 to 5. The adjustable wrench of the present invent ion includes a main body 1, a slide block 2, a movable jaw 3 and a grip 4.

The main body 1 is composed of two cover plates 11. A jaw section 12 upward extends from one side of the main body 1. The lower port ion of the main body I has a hollow section 13 in which the slide block 2 and the movable jaw 3 are disposed. The grip 4 is pivotally connected with the hollow section 13. The hollow section 13 passes through the top and bottom faces of the main body 1. Two sides of upper portion of the hollow section 13 are respectively formed with two slide channels 14 passing through two sides of the main body 1.

The upper portion of the slide block 2 is formed with a projecting section 21 having a profile complementary to that of the slide channels 14 of the main body 1. The projecting section 21 is movably inlaid in the slide channels 14 of the main body 1. The top face of the projecting section 21 is formed with a semicircular groove 22 passing through two sides of the projecting section 21. A middle portion of the slide block 2 is formed with a receiving slot 23. The main body 1 has a pin member 15 passing through the middle portion of the receiving slot 23. Two restoring springs 16 are respectively positioned between two side walls of the receiving slot 23 and the pin member 15. In addition, a leaning section 24 projects from the lower portion of the slide block 2.

The lower portion of the movable jaw 3 is a projecting rail 31 complementary to the slide channels 14 of the main body 1. The bottom face of the projecting rail 31 is formed with a concave face 32 cooperating with the semicircular groove 22 of the slide block 2. The concave face 32 is formed with a thread. The projecting rail 31 of the movable jaw 3 and the projecting section 21 of the slide block 2 together form a shape complementary to the shape of the slide channels 14 of the main body 1. A bolt 33 is passed through the concave face 32 of the movable jaw 3 and the semicircular groove 22 of the slide block 2 with the bolt 33 screwed with the thread of the concave face 32. Two locating blocks 34 are respectively disposed at two ends of the bolt 33 to respectively abut against two end faces of the projecting section 21 of the slide block 2 for locating the bolt 33.

The upper section of the grip 4 is pivotally connected with the lower portion of the hollow section 13 of the main body 1. A movable retaining block 5 is disposed on one side of the top end of the grip 4 opposite to the leaning section 24 of the slide block 2. One side of the retaining block 5 has a projecting block 51 which is slidably inserted in a slot 41 of the grip 4. A locating steel ball 53 pushed by a spring 52 is disposed in the retaining block 5. The lateral edge of the grip 4 is formed with two dents 42 corresponding to the moving position of the retaining block 5. The locating steel ball 53 can be engaged in the dent 42 for locating the retaining block 5. A rod member 54 is passed through the retaining block 5. The main body 1 is formed with an arch slot 17 corresponding to the moving track of the retaining block 5. The rod member 54 passes through the arch slot 17 and extends out of the main body 1 to connect with a shifting block 55. One side of the top end of the grip 4 is formed with a recessed section 43 opposite to the retaining block 5. The main body 1 is formed with a hole 101 corresponding to the recessed section 43. A spring 18 and a steel ball 19 pushed by the spring 18 to lean against the recessed section 43 are disposed in the hole 101.

Figure 6:
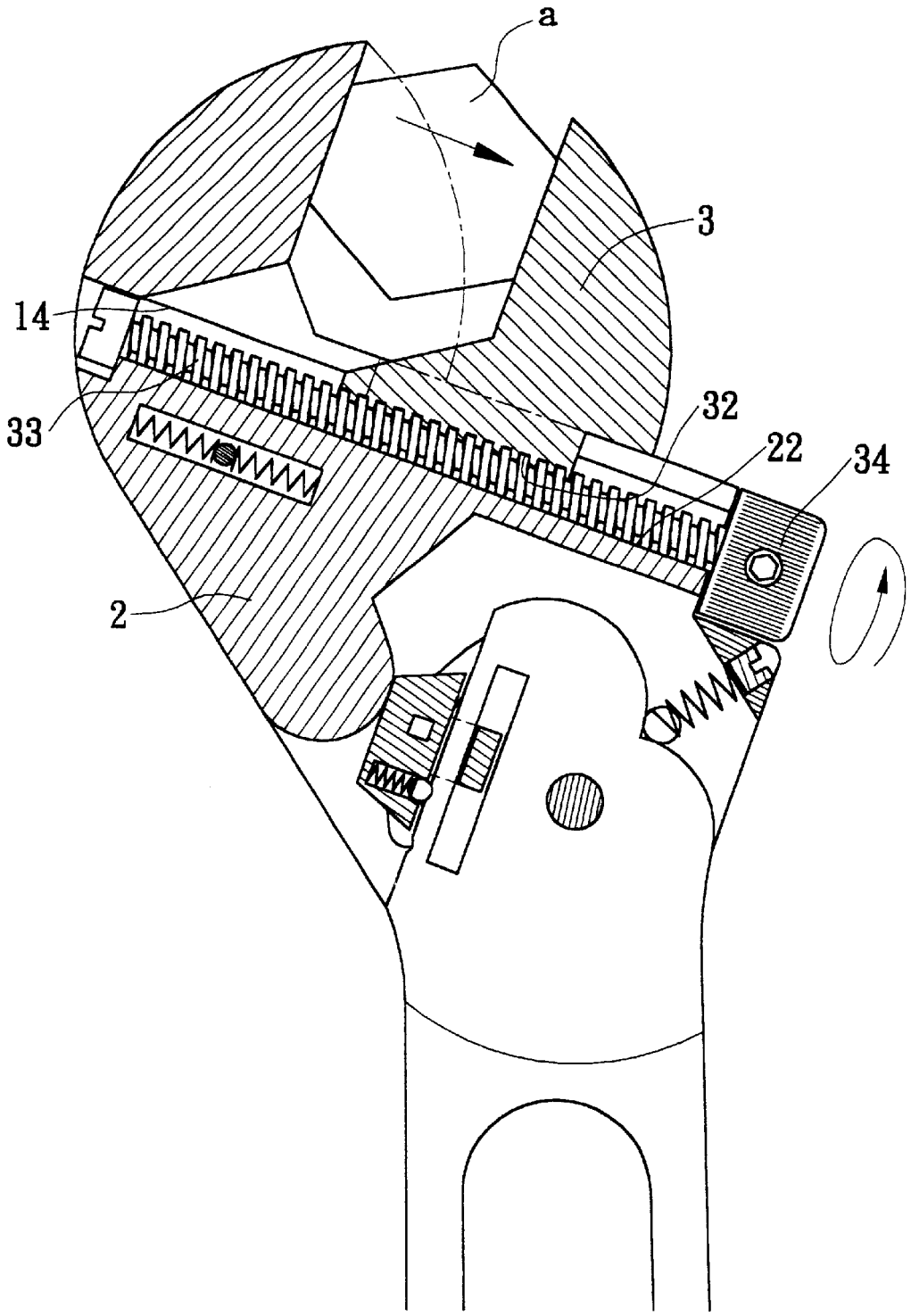
FIG. 6 shows the adjustment of the movable jaw of the present invention.

In use, a user can via the locating block 34 of the bolt 33 rotate the bolt 33 so as to drivingly move the movable jaw 3 within the slide channels 14 as shown in FIG. 6 so as to adjust the distance between the movable jaw 3 and the jaw section 12 of the main body 1 for clamping different work pieces a (such as bolt, nut, etc.) with different sizes.

Figure 7A:
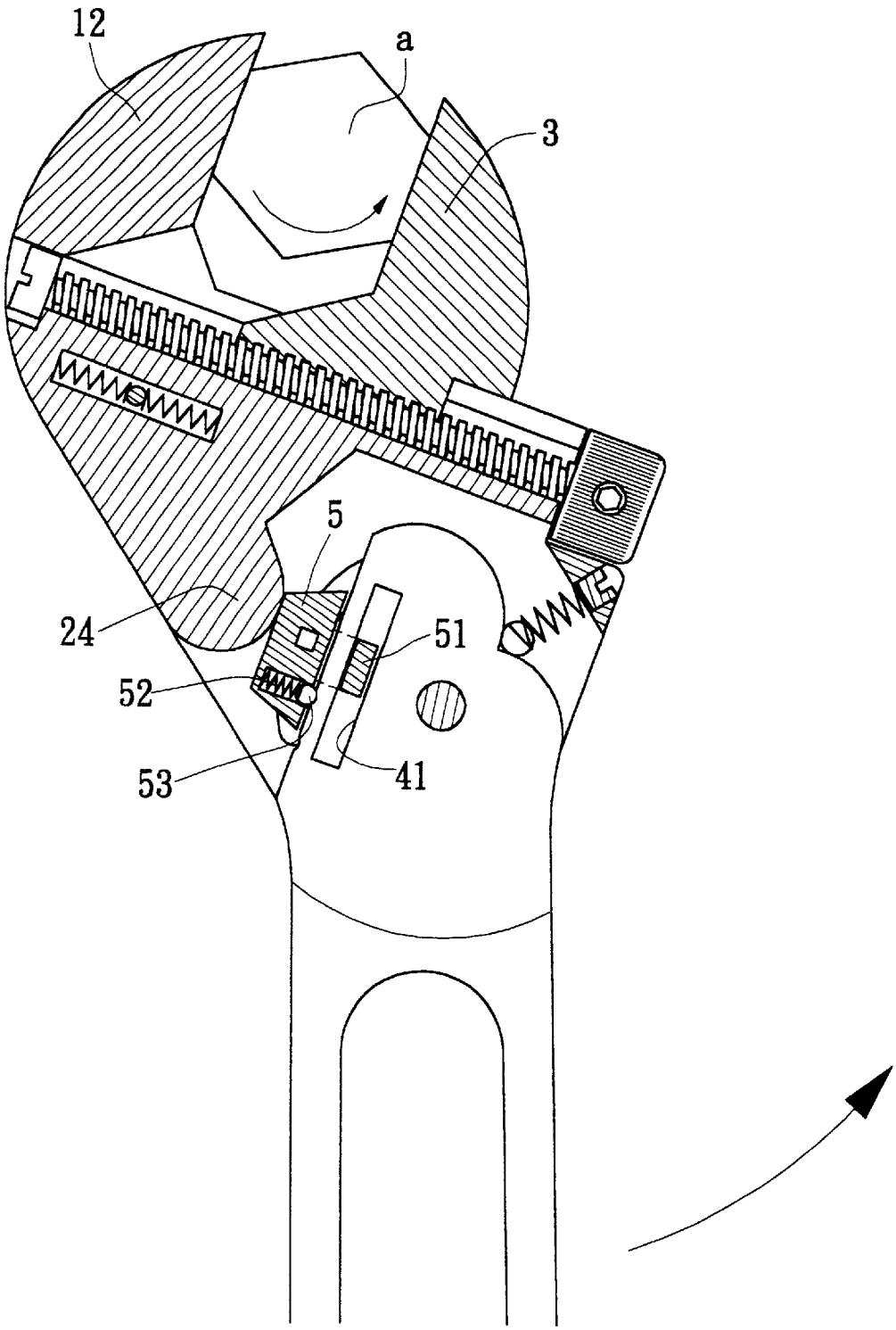
FIG. 7A shows the use of the present invention in one state.
Figure 7B:
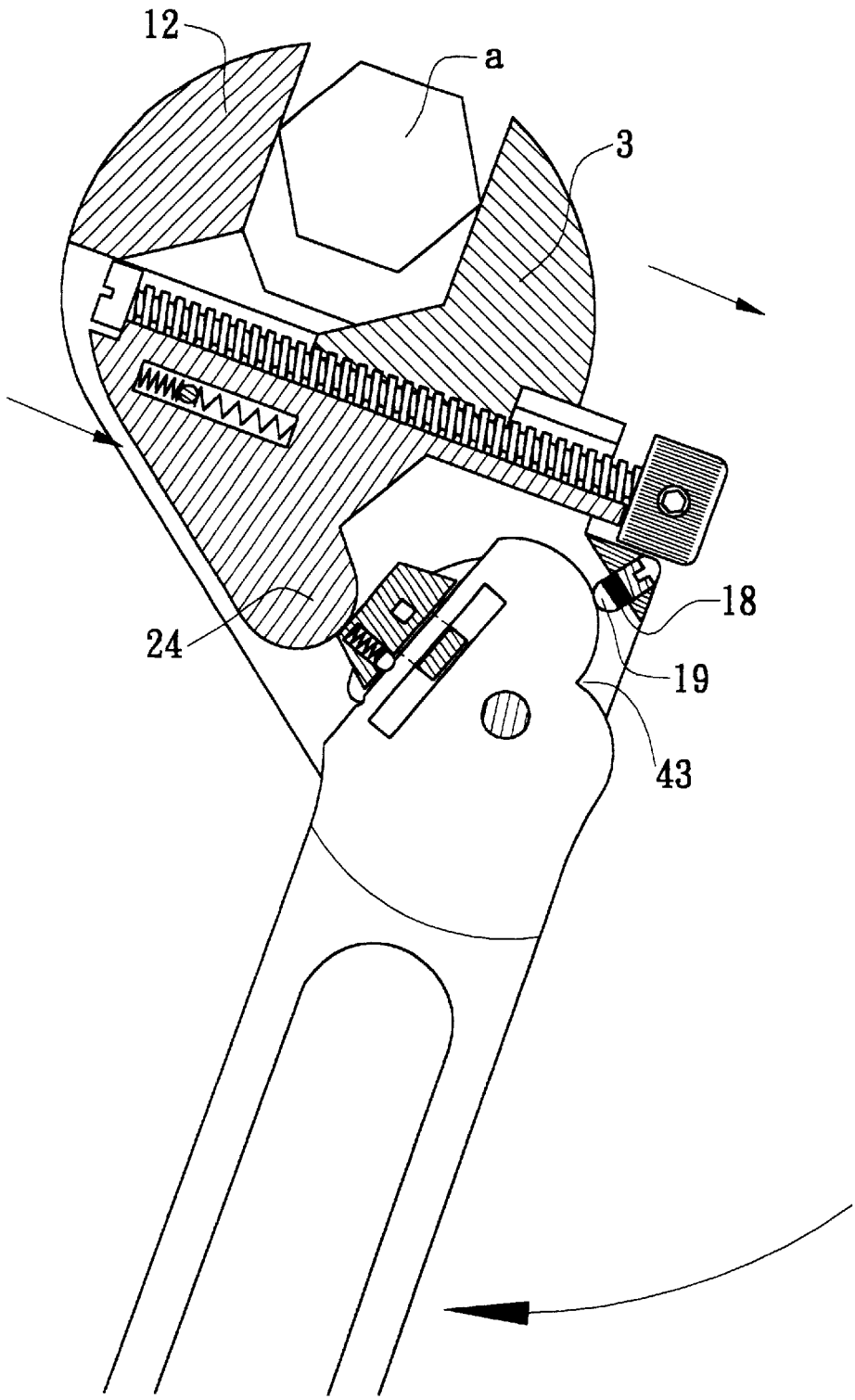
FIG. 7B shows the use of the present invention in another state.
Figure 8A:
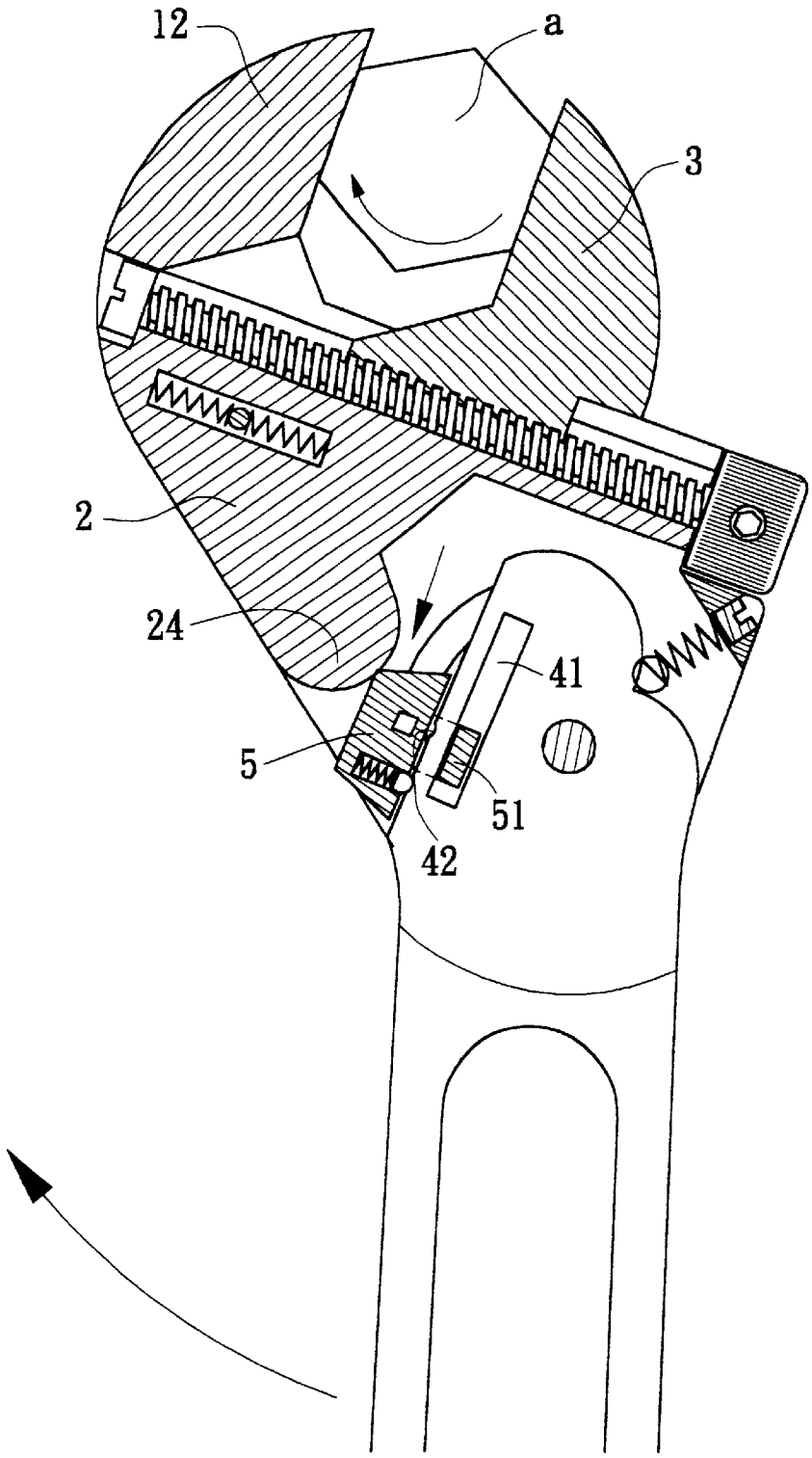
FIG. 8A shows the use of the present invention in still another state.
Figure 8B:
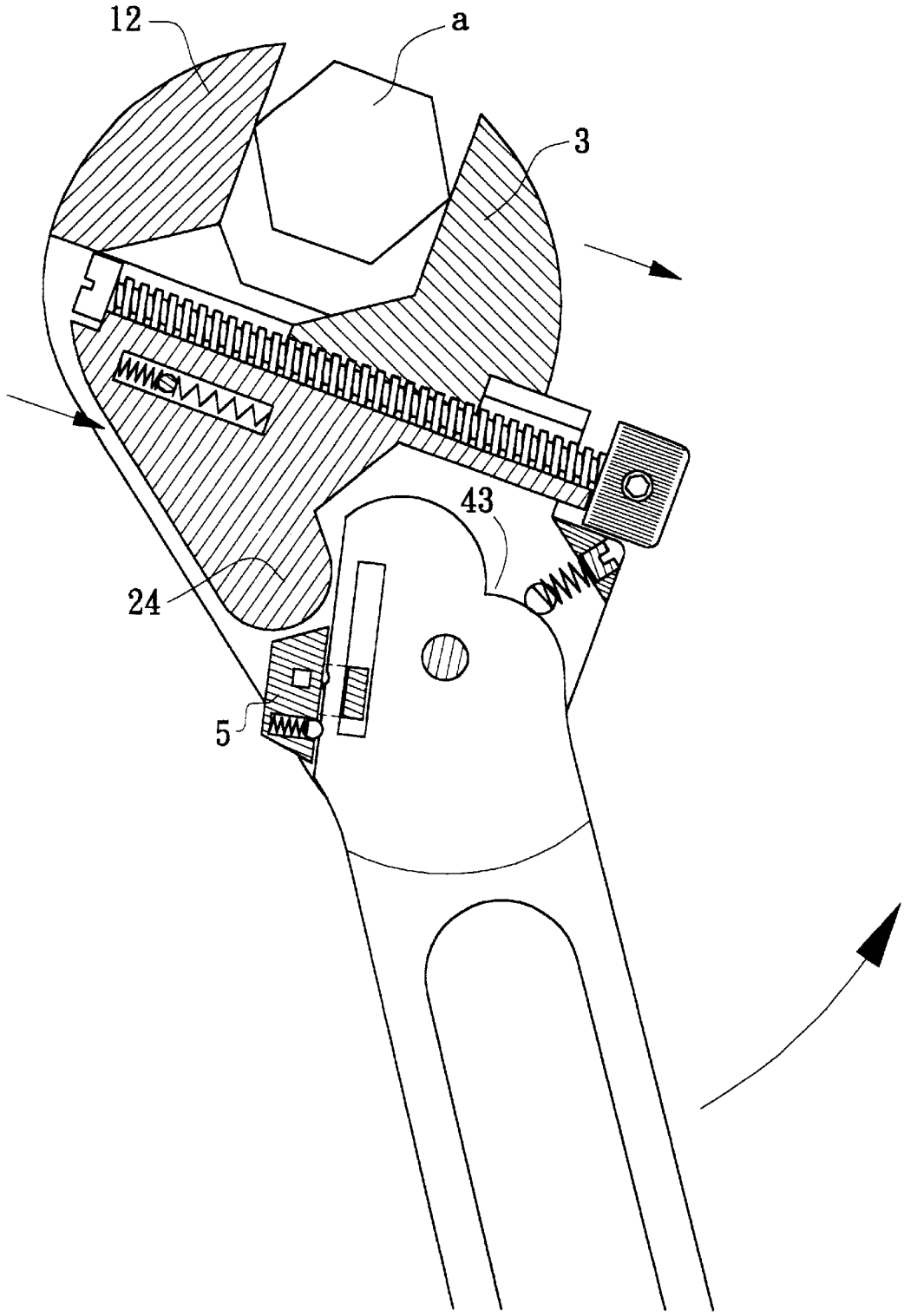
FIG. 8B shows the use of the present invention in still another state.

Please refer to FIGS. 7A and 7B. When the user shifts the shifting block 55 upward to a fixed position, the locating steel ball 53 is engaged in the upper dent 42 of the grip 4 to locate the shifting block 55. At this time, the retaining block 5 is positioned on a lateral side of the leaning section 24 of the slide block 2. Under such circumstance, in the case that the user counterclockwise wrenches the grip 4 in a direction as shown in the figure, the retaining block 5 will abut against the leaning section 24 of the slide block 2 to push the slide block 2 toward the jaw section 12 of the main body 1. The bolt 33 is located on the slide block 2 by the two locating blocks 34 so that the movable jaw 3 screwed with the bolt 33 is driven to tightly clamp the work piece a and wrench the work piece a counterclockwise. When the user clockwise wrenches the grip 4, the retaining block 5 is moved away from the leaning section 24 of the slide block 2. When the main body 1 is driven by the grip 4 to rotate clockwise, the movable jaw 3 and the slide block 2 are not pushed and will be forced open in reverse direction by the work piece a. Therefore, when the main body 1 is rotated, the work piece a is not driven to rotate so that the main body 1 is idled. Please refer to FIGS. 8A and 8B, when the user desires to clockwise wrench the work piece a, the user only needs to push the shifting block 55 downward to make the retaining block 55 move downward to the lower side of the leaning section 24 of the slide block 2. At this time, by means of clockwise wrenching the grip 4, the retaining block 5 will abut against the leaning section 24 of the slide block 2. Under such circumstance, the movable jaw 3 is driven to tightly clamp the work piece a and wrench the work piece a clockwise. When the user counterclockwise wrenches the grip 4, the retaining block 5 is moved away from the leaning section 24 of the slide block 2 to make the main body 1 idle. Accordingly, by means of switching the shifting block 55, the wrenching direction of the adjustable wrench of the present invention during repeated wrenching operation for the work piece a can be changed.

When wrenching the grip 4, the steel ball 19 is pushed by the spring 18 of the main body I to resiliently abut against the recessed section 43 of the grip 4. Therefore, after wrenched, the spring 18 pushes the steel ball 19 to resiliently push the recessed section 43 of the grip 4 so as to restore the grip 4 to its home position.

In conclusion, when the retaining block 5 abuts against the leaning section 24 of the slide block 2, the jaw section 12 of the main body 1 and the movable jaw 3 cooperatively clamp the work piece a to rotate. When the leaning section 24 is not pressed by the retaining block 5 and the grip 4 is wrenched, the slide block 2 and the movable jaw 3 are shifted by the work piece a to make the main body 1 idle. By means of switching the shifting block 55, the one-way wrenching direction of the adjustable wrench of the present invention during repeated wrenching operation for the work piece a can be changed.

Figure 9:
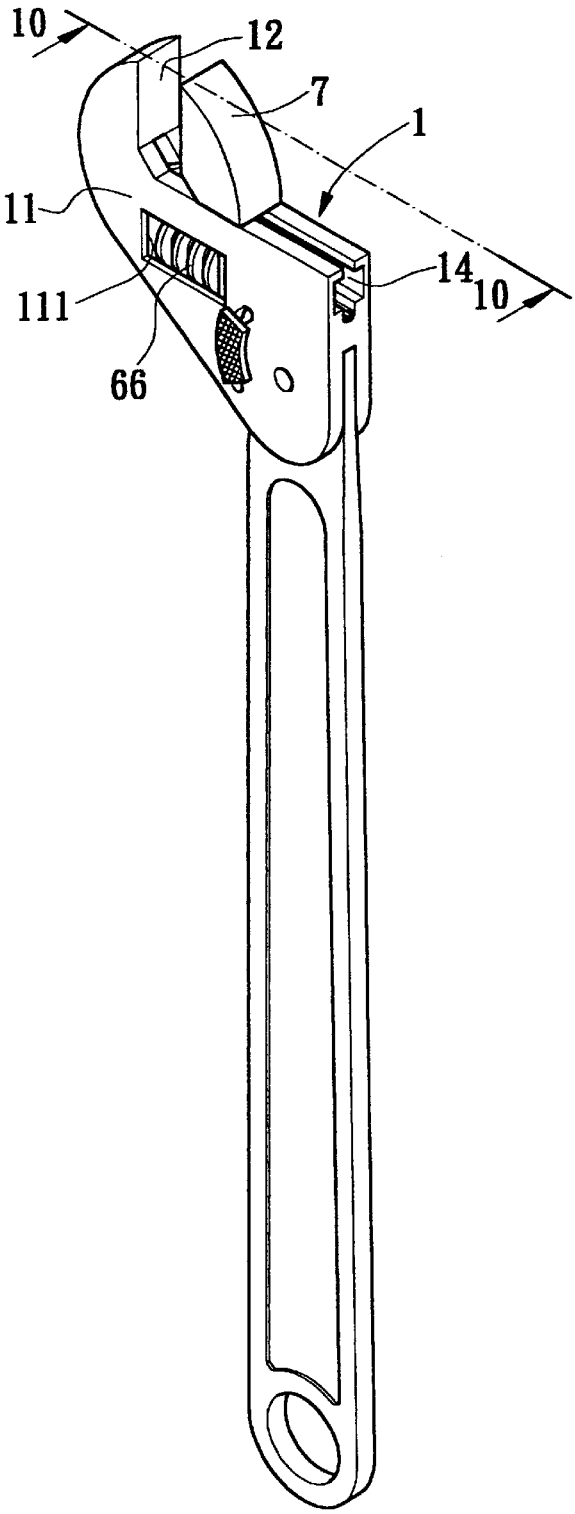
FIG. 9 is a perspective assembled view of a second embodiment of the present invention.
Figure 10:
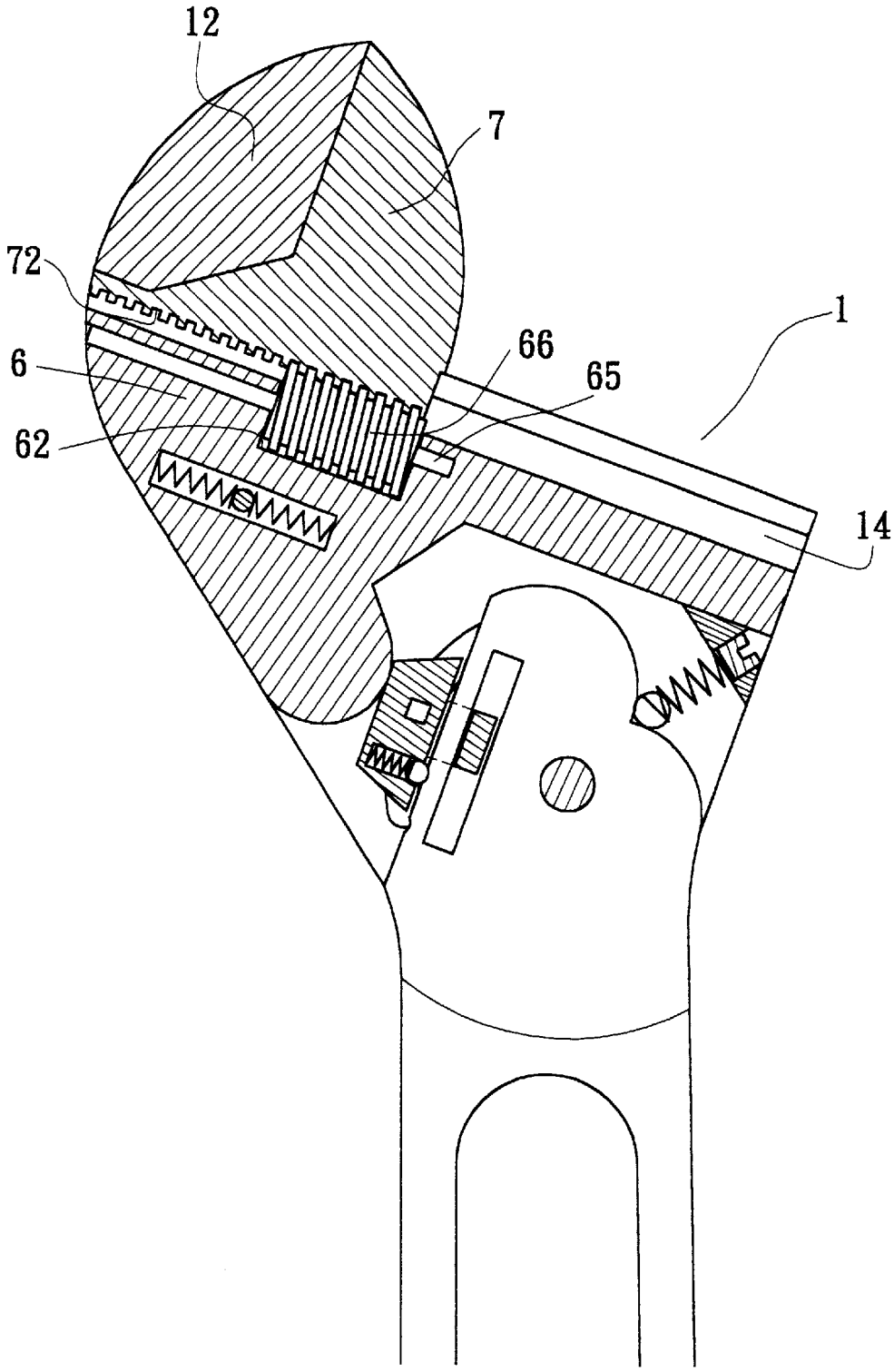
FIG. 10 is a sectional view taken along line 10—10 of FIG. 9.
Figure 11:
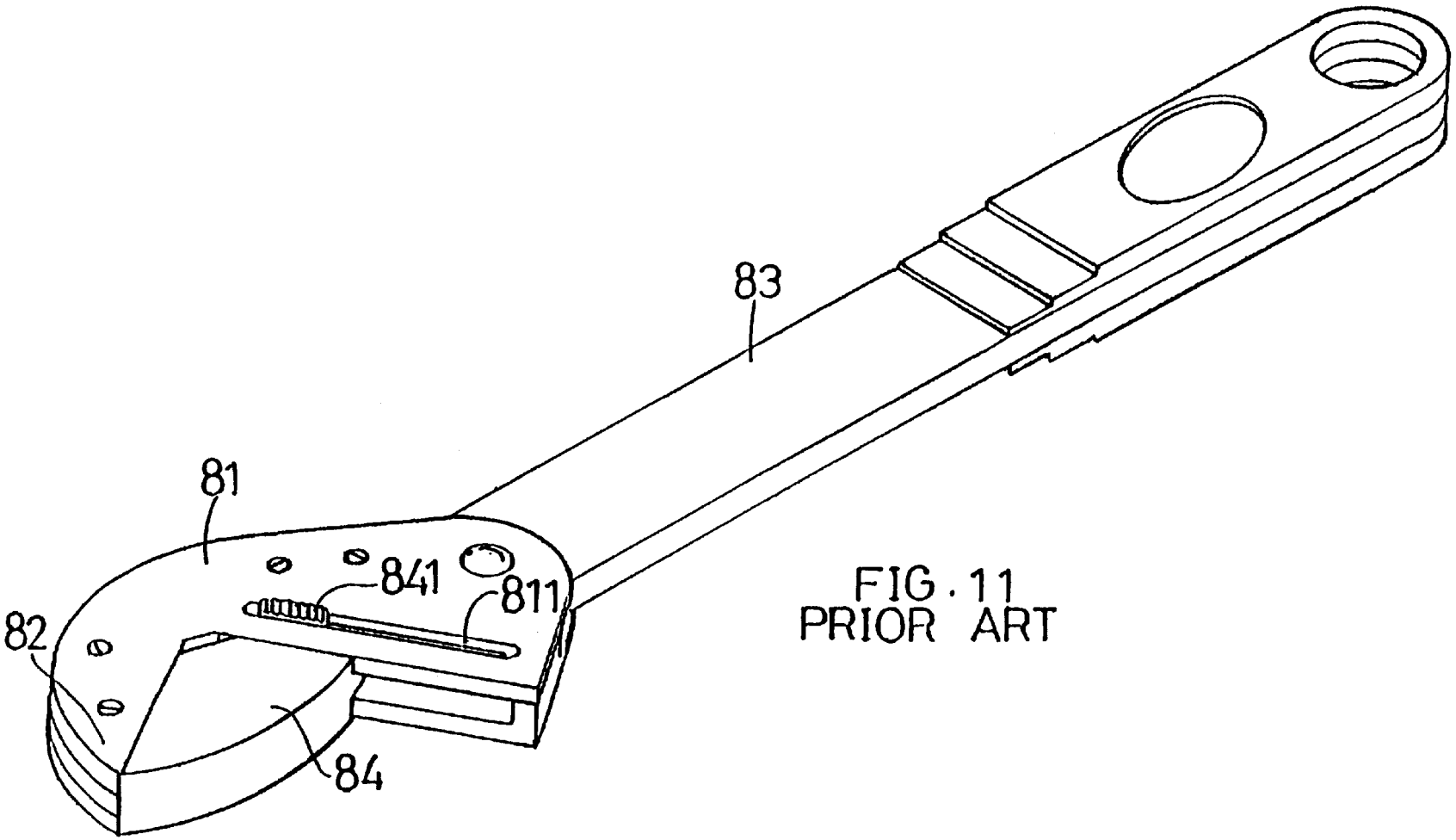
FIG. 11 PRIOR ART
FIG. 11 is a perspective assembled view of a conventional adjustable wrench.
Figure 12:
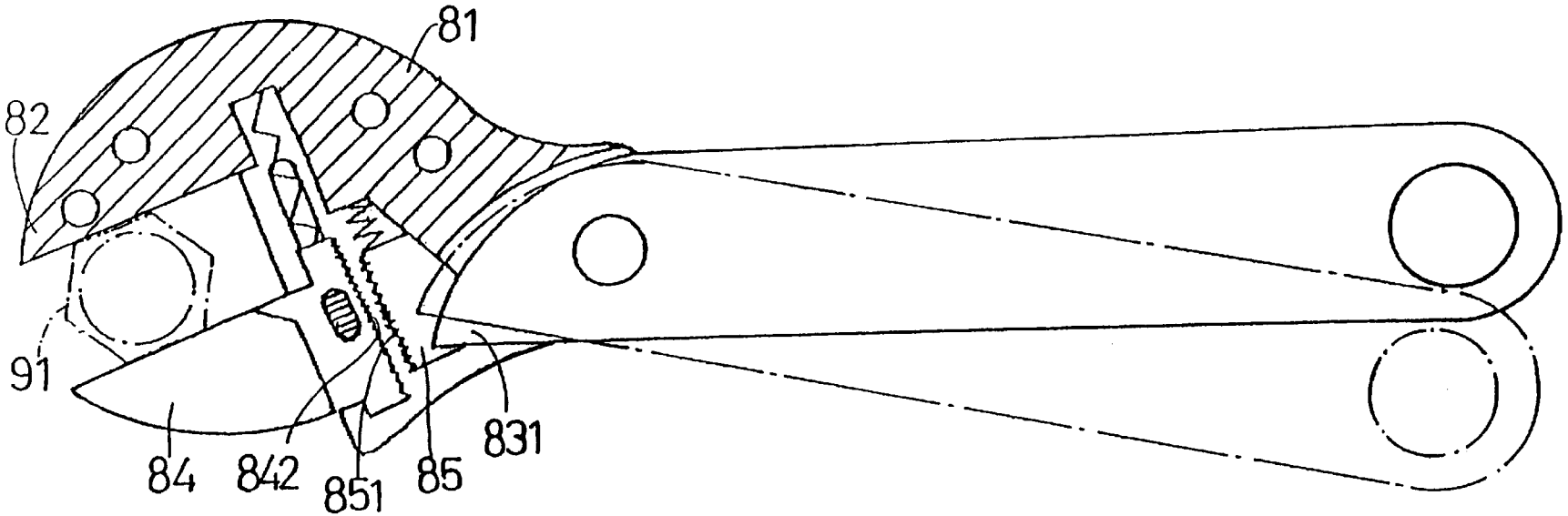
FIG. 12 PRIOR ART
FIG. 12 shows the use of the conventional adjustable wrench.

FIGS. 9 and 10 show a second embodiment of the present invention, in which the top face of a middle portion of the slide block 6 is formed with a groove 62. A spiral rod 66 via a shaft 65 is rotatably disposed in the groove 62. The bottom face of the movable jaw 7 is formed with teeth 72 corresponding to the spiral rod 66. Each cover plate 11 is formed with a notch Ill corresponding to the spiral rod 66. Accordingly, a user can rotate the spiral rod 6 outsides so as to drive the movable jaw 7 to move within the slide channels 14 of the main body 1 and adjust the gap between the movable jaw 7 and the jaw section 12 in accordance with the size of the work piece a. This can achieve the same function as the first embodiment.

The above embodiments are only used to illustrate the present invention, not intended to limit the scope thereof. Many modifications of the above embodiments can be made without departing from the spirit of the present invention.

What is claimed is:

1. An Adjustable wrench comprising a main body, a slide block, a movable jaw and a grip, wherein:

a jaw section upward extends from one side of the main body, a lower portion of the main body having a hollow section in which the slide block and the movable jaw are disposed, the grip being pivotally connected with the hollow section, the hollow section passing through a top and a bottom faces of the main body, two sides of upper portion of the hollow section being respectively formed with two slide channels passing through two sides of the main body;

an upper portion of the slide block is formed with a projecting section having a profile complementary to that of the slide channels of the main body, the projecting section being movably inlaid in the slide channels of the main body, a top face of the projecting section being formed with a semicircular groove passing through two sides of the projecting section, the slide block being formed with a receiving slot, the main body having a pin member passing through a middle portion of the receiving slot, two restoring springs being respectively positioned between two side walls of the receiving slot and the pin member, a leaning section projecting from the lower portion of the slide block;

a lower portion of the movable jaw is a projecting rail complementary to the slide channels of the main body, a bottom face of the projecting rail being formed with a concave face cooperating with the semicircular groove of the slide block, the concave face being formed with a thread, the projecting rail of the movable jaw and the projecting section of the slide block together forming a shape complementary to the shape of the slide channels of the main body, a bolt being passed through the concave face of the movable jaw and the semicircular groove of the slide block with the bolt screwed with the thread of the concave face, two locating blocks being respectively disposed at two ends of the bolt to respectively abut against two end faces of the projecting section of the slide block for locating the bolt; and an upper section of the grip is pivotally connected with the lower portion of the hollow section of the main body, a movable retaining block being disposed on one side of the top end of the grip opposite to the leaning section of the slide block, one side of the top end of the grip being formed with a recessed section opposite to the retaining block, the main body being formed with a hole corresponding to the recessed section, a spring and a steel ball pushed by the spring to lean against the recessed section being disposed in the hole.

2. An Adjustable wrench as claimed in claim 1, wherein one side of the retaining block has a projecting block which is slidably inserted in a slot 41 of the grip, a locating steel ball pushed by a spring being disposed in the retaining block, a lateral edge of the grip being formed with two dents corresponding to the moving position of the retaining block, whereby the locating steel ball can be engaged in any of the dents for locating the retaining block.

3. An Adjustable wrench as claimed in claim 1, wherein a rod member is passed through the retaining block, the main body being formed with an arch slot corresponding to the moving track of the retaining block, the rod member passing through the arch slot and extending out of the main body to connect with a shifting block.

4. An Adjustable wrench as claimed in claim 1, wherein the top face of middle portion of the projecting section of the slide block is formed with a groove, a spiral rod via a shaft being rotatably disposed in the groove, the bottom face of projecting rail of the movable jaw being formed with teeth corresponding to the spiral rod, each cover plate of the main body being formed with a notch corresponding to the spiral rod, whereby a user can rotate the spiral rod outsides so as to drive the movable jaw.

* * * * *